US010871054B2

(12) United States Patent
Andreychuk et al.

(10) Patent No.: US 10,871,054 B2
(45) Date of Patent: Dec. 22, 2020

(54) CLOSEABLE SLEEVE ASSEMBLY AND METHOD OF USE

(71) Applicant: KOBOLD CORPORATION, Calgary (CA)

(72) Inventors: Mark Andreychuk, Calgary (CA); Allan Petrella, Calgary (CA); Per Angman, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 77 days.

(21) Appl. No.: 16/159,237

(22) Filed: Oct. 12, 2018

(65) Prior Publication Data

US 2019/0112896 A1 Apr. 18, 2019

Related U.S. Application Data

(60) Provisional application No. 62/571,591, filed on Oct. 12, 2017, provisional application No. 62/577,025, filed on Oct. 25, 2017, provisional application No. 62/619,667, filed on Jan. 19, 2018.

(51) Int. Cl.

| | |
|---|---|
| ***E21B 34/10*** | (2006.01) |
| ***E21B 23/00*** | (2006.01) |
| ***E21B 23/04*** | (2006.01) |
| ***E21B 34/12*** | (2006.01) |
| ***E21B 34/14*** | (2006.01) |

(52) U.S. Cl.

CPC ..... *E21B 34/102* (2013.01); *E21B 23/00* (2013.01); *E21B 23/04* (2013.01); *E21B 34/12* (2013.01); *E21B 34/14* (2013.01); *E21B 2200/06* (2020.05)

(58) Field of Classification Search

CPC ..... E21B 34/102; E21B 34/12; E21B 34/14; E21B 23/00; E21B 23/04; E21B 23/006; E21B 2034/007

See application file for complete search history.

(56) References Cited

U.S. PATENT DOCUMENTS

| | | | | |
|---|---|---|---|---|
| 6,173,795 | B1 * | 1/2001 | McGarian | E21B 23/006 175/231 |
| 6,422,317 | B1 * | 7/2002 | Williamson, Jr. | E21B 34/10 166/320 |
| 9,085,974 | B2 * | 7/2015 | Schreiber | E21B 33/138 |

(Continued)

*Primary Examiner* — David Carroll

(74) *Attorney, Agent, or Firm* — Parlee McLaws LLP; Chi Fai Andrew Lau

(57) ABSTRACT

A sleeve assembly has a sleeve axially moveable within a housing, the sleeve being positively locatable within a wellbore for reliable axial shifting of the sleeve between an uphole position and a downhole position. Stops and shoulders, which delimit the shifting of the sleeve between open and closed positions, are located in an annulus between the sleeve and the housing. Uphole and downhole ends of the sleeve and the housing have opposing ramps formed thereon. Locating shifting tools run through the sleeve assembly are engageable only in a locating profile in the sleeve and cannot engage in the annular stops or in gaps formed in the bore, uphole and downhole of the sleeve, as the ramps act to guide the locating tool therethrough. As the uphole and downhole sleeve ramps converge toward either of the uphole or downhole housing ramps during shifting thereof, debris is diverted into the bore allowing the sleeve to shift fully uphole or downhole.

28 Claims, 9 Drawing Sheets

(56) References Cited

U.S. PATENT DOCUMENTS

| | | | | |
|---|---|---|---|---|
| 2004/0026091 | A1* | 2/2004 | Patel | E21B 21/10 166/386 |
| 2006/0124310 | A1* | 6/2006 | Lopez de Cardenas | E21B 34/06 166/313 |
| 2009/0084553 | A1* | 4/2009 | Rytlewski | E21B 34/06 166/305.1 |
| 2009/0229828 | A1* | 9/2009 | Ross | E21B 34/10 166/319 |
| 2013/0319687 | A1* | 12/2013 | Huh | E21B 34/14 166/381 |

* cited by examiner

CLOSEABLE SLEEVE ASSEMBLY AND METHOD OF USE

CROSS-REFERENCE TO RELATED APPLICATIONS

This application claims the benefit of each of U.S. Provisional Patent Application Ser. No. 62/571,591, filed on Oct. 12, 2017, U.S. Provisional Patent Application Ser. No. 62/577,025, filed on Oct. 25, 2017 and U.S. Provisional Patent Application Ser. No. 62/619,667, filed on Jan. 19, 2018, the entirety of each of which is incorporated herein by reference.

FIELD

Embodiments taught herein are related to shiftable sleeves for opening and closing ports in a tubular and, more particularly, to sleeves, which can be shifted between open and closed positions one or more times.

BACKGROUND

Sleeve valve assemblies installed in a completion string, such as casing, are known for opening and closing ports to facilitate production and/or treatment of the formation, such as in a fracturing operation. The sleeves are general releasably retained over the ports in a closed position and are actuated to slide or shift within the casing to open the ports. Many different types of sleeves and apparatus to actuate the sleeves are known in the industry.

In wellbore operations, fluids delivered to the wellbore, such as from a treatment tool run into the casing and a bore of the sleeve, are directed into the formation through the open ports. At least one sealing means, such as a packer, is employed to isolate the balance of the wellbore from the treatment fluids, such as below the sleeve.

It is known that tools, such as treatment tools and the like are often set high or low with respect to the sleeve largely because the sleeve has not been positively located within the casing. Failures to properly locate the tool in the casing are costly.

Further, it has been noted that over time and operation of a plurality of open/close cycles, prior art sleeves experience an unacceptable percentage of failed pressure tests. The failed pressure tests are indicative that the sleeve has failed to seal the ports, and may be locked in either the open position or the closed position. Further, the failed pressure tests may be indicative that seals, which normally prevent leakage through the ports particularly in the closed position, may have been damaging during shifting of the sleeve, such as by shifting over debris, may have been eroded as a result of fluid flow within the tool and through the ports, or both.

Sleeve locations and functioning failures significantly impact service reliability, such as during a wellbore fracturing operation. For at least this reason, there is great interest in developing sleeves that are reliably located, that reliably seal, that reliably open and/or close and that remain locked in position until functioned to shift.

SUMMARY

Embodiments taught herein utilize co-operating uphole and downhole annular stops and shoulders acting between housing and a sleeve shiftable axially therein to delimit the shifting of the sleeve between uphole and downhole positions for closing and opening ports in the housing. The stops and shoulders are isolated from a housing bore and a sleeve bore. Locating tools, which are run downhole through the housing bore and sleeve bore and are pulled uphole in the sleeve bore to locate, engage in a locating profile in the sleeve for positively locating the tool in the sleeve. Unlike the prior art sleeves, which position the delimiting stops in the bore of the housing, the locating tool cannot engage unintendedly with the annular stops, falsely indicating location of the tool within the sleeve. Thus, in embodiments, the sleeve is positively located.

In embodiments, the locating tool is also used to shift the sleeve and may be conveyed on a treatment tool, such as a frac tool.

In one broad aspect, a sleeve assembly comprises a tubular sleeve housing having a housing bore formed therethrough, the housing having one or more ports formed therethrough; and a shifting profile formed in an inner surface of the housing, the shifting profile having an uphole shoulder and a downhole shoulder. An axially shiftable tubular sleeve is housed within the bore of the sleeve housing and forms a sleeve annulus therebetween. The sleeve has a bore formed therethrough. A locating profile is formed in an interior of the sleeve, adapted for engaging a shifting locator therein. Annular uphole and downhole stops formed on an exterior of the sleeve and extending into the sleeve annulus for engaging the uphole and downhole shoulders of the shifting profile delimit axial movement of the sleeve between a closed position, wherein the sleeve blocks the ports, and an open position, wherein the sleeve is shifted axially away from the ports.

In another broad aspect, a method for positively locating a locating profile in a sleeve, the sleeve being axially moveable within a housing for shifting the sleeve axially therein between uphole and downhole positions, comprises running a locating shifting tool downhole, through a bore of the sleeve, to below a downhole end of the sleeve. The locating shifting tool is pulled uphole, the locating shifting tool being guided uphole past the downhole end of the sleeve by a downhole sleeve ramp formed thereon. The locating shifting tool is continued to be pulled uphole to engage at an uphole stop in the locating profile. The locating shifting tool and sleeve engaged therewith is axially moved between the uphole and downhole positions, wherein uphole and downhole stops in an annulus between the sleeve and the housing engage uphole and downhole shoulders therein, the annular stops and annular shoulders acting between the sleeve and the housing to delimit the axial movement of the sleeve.

Unlike prior art sleeves which limit the travel or shift distance of the sleeve to be shorter in length than the locating profile to minimize engaging the locating tool above or below the sleeve, the annular delimiting stops and shoulders permit an increase in the travel distance of the sleeve. The increased travel distance allows a greater length of sealing interface between the sleeve and the housing for more reliable sealing capability. Further, spacing the uphole end of the sleeve further away from ports in the housing when the sleeve is in the open position improves erosion resistance.

Ramps formed at the uphole and downhole ends of the sleeve and the housing, guide the locating tool into and out of the housing bore and the sleeve bore. Thus, the locating tool does not engage in gaps formed above and below the sleeve and provide a false indication the tool is located in the sleeve. Instead the locating tool engages only within the locating profile and indications at surface can be relied on to positively indicate location of the tool within the sleeve.

The ramps further act, particularly on a low side of a horizontal wellbore to displace debris into the bore and away from ends of the sleeve and housing as the sleeve ramps converge toward the housing ramps as the sleeve is shifted axially between uphole and downhole positions. Removal of debris between the sleeve and the housing allows the sleeve to shift fully to the uphole and downhole positions and increases the reliability of locking mechanisms, such as detents, which act between the sleeve and the housing to hold the sleeve in uphole and downhole positions until functioned to shift therefrom. Removal of debris also minimizes damage to seals which might otherwise occur as the sleeve and seals are shifted thereover.

DETAILED DESCRIPTION

Prior Art Sleeve Assemblies

Figure 1:
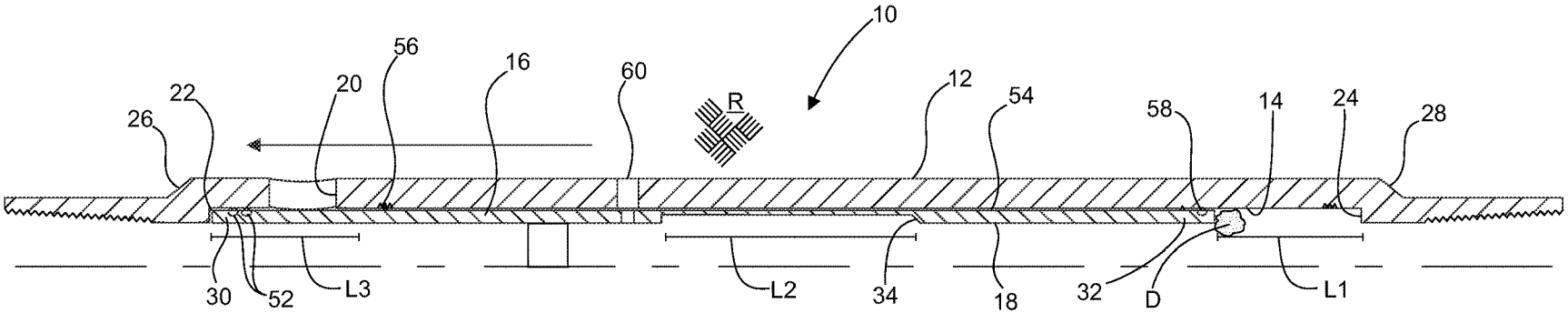
Fig. 1 PRIOR ART
FIG. 1 is a cross-sectional view of one side of a shifting sleeve assembly, according to the prior art, the sleeve shown in a closed position, an opposing identical wall having been removed for simplicity.
Figure 2:
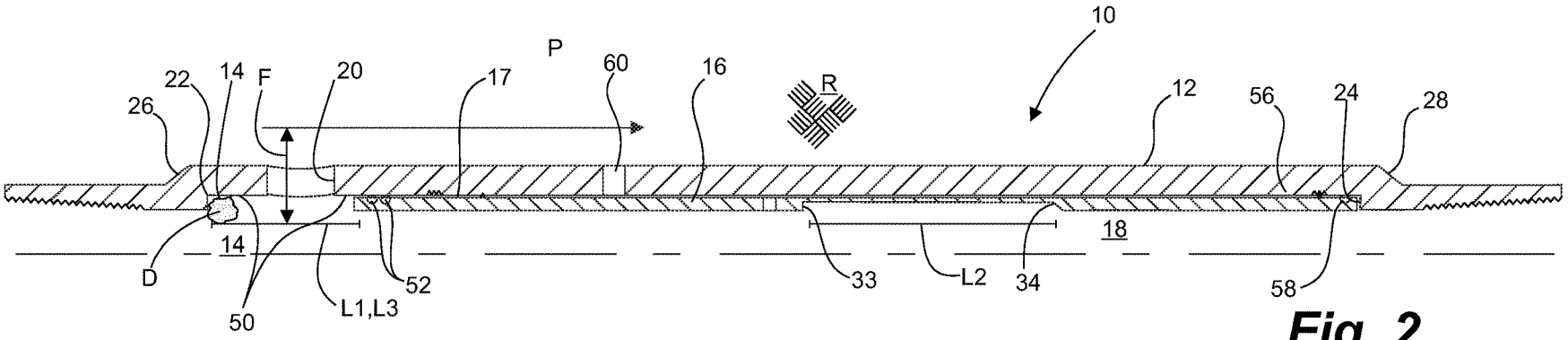
Fig. 2 PRIOR ART
FIG. 2 is a cross-sectional view of the prior art sleeve assembly according to FIG. 1, the sleeve shown in an open position.

As shown in FIGS. 1 and 2, prior art sleeve assemblies 10 are generally incorporated within a completion string, such as casing, set in a wellbore drilled through one or more reservoirs. The sleeve assemblies 10 comprise an outer sleeve or tubular housing 12 having a bore 14 formed therethrough and an internal tubular sleeve 16 axially moveable therein. The sleeve 16 has a sleeve bore 18 formed therethrough. An annulus 17 is formed between the sleeve 16 and the housing 12. The housing 12 has one or more ports 20 formed therein through which fluids F can flow. The sleeve 16 is axially moveable between a closed position (FIG. 1), wherein the sleeve 16 blocks the flow of fluid F through the ports 20, and an open position (FIG. 2), wherein the sleeve 16 is shifted axially away from the ports 20, allowing the fluids F to flow therethrough. In embodiments, the prior art sleeve assemblies 10 are shifted to the downhole to open the ports 20 in the open position.

Uphole and downhole internal delimiting shoulders 22,24, such as adjacent an uphole end 26 and a downhole end 28 of the housing 12, protrude radially inwardly into the housing bore 14 and engage uphole 30 and downhole ends 32 of the sleeve 16, respectively. Thus, the distance the sleeve 16 can shift axially in the housing 12 between the open and closed positions is delimited.

Sleeves 16 in the completion string 11 are generally located using a location tool. Prior art sleeves 16 are known to be located using a location tool that engages an uphole stop 33 within a locating cavity or profile 34 in the sleeve bore 18.

Having reference to FIG. 3 and FIGS. 9A-9D, and as taught in Applicant's US published application US2017-0058644-A1, incorporated herein by reference in its entirety, in embodiments separate locating and shifting tools are not required. A locating shifting tool is used to both locate and shift the sleeve and can be incorporated into a treatment tool 40 taught therein, such as a frac tool.

Dogs 36, supported on radially outwardly biased dog arms 38 on the treatment tool 40, run into the completion string, such as on coiled tubing (CT), and through the bores 18 of the sleeves 16, engage the uphole stop 33 within the locating profile 34 when pulled uphole to locate the sleeve. The dogs 36 have uphole and downhole interfaces 42 which are urged radially outwardly into engagement with the locating profile 34. The dogs 36 are urged radially outwardly as an axially manipulated activation mandrel 35, connected to an axially indexing J-slot mechanism (FIGS. 8A-8D), is cycled for axially driving a dog locking cone 37 beneath the dogs 36 for gripping in the locating profile 34. Once the dogs 36 are locked in the locating profile 34, the treatment tool 40 is used to shift the sleeve 16 downhole for opening the ports 20 and uphole for closing the sleeve 16.

Figure 3:
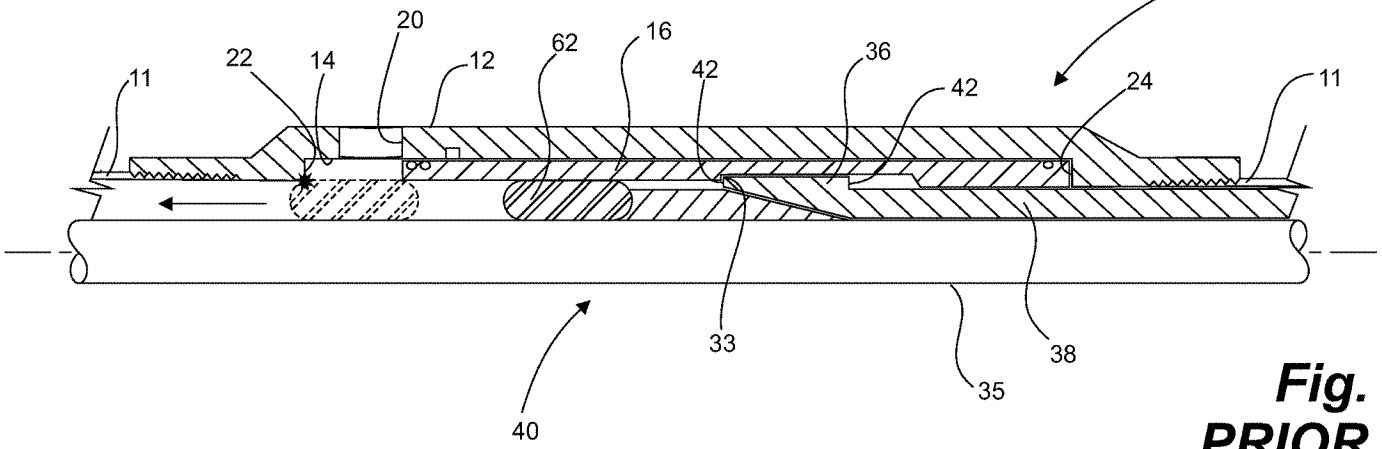
Fig. 3 PRIOR ART
FIG. 3 is a cross-sectional view of the prior art sleeve assembly, according to FIG. 1, engaged for shifting uphole, a packer element poised to swab over frac ports and into engagement with an uphole shoulder in the prior art sleeve, causing damage to the element.

The prior art sleeves, shown in FIGS. 1 to 3, engageable by the dogs 36 at the location profile 34 as described above, have a limited shift length L1 for opening and closing the ports 20. The shift length L1 is less than a second locating length L2 between the uphole and downhole stops of the locating profile 34. The shorter shift length L1 prevents engagement of the locator dogs 36 by the internal delimiting shoulders 22,24, which define the shift length L1 and would, if engaged, result in falsely locating the treatment tool 40, such as a frac tool.

As can be best seen in FIG. 2, the limited shift length L1 also results in a limited sealing length L3 of an internal surface or sealing interface 50, uphole and downhole of the ports 20 in the housing 12. The limited internal sealing interface 50 engages uphole sleeve seals 52, located on an exterior surface 54 at the uphole end 30 of the sleeve 16, in the closed position. Further, the limited sealing interface 50 is generally located in close proximity to the ports 20, exposing the sealing interface 50 to the flow of fluid F therethrough, such as a fracturing or treatment fluid, and increasing the likelihood of damage to the sealing interface 50 and/or the two uphole sleeve seals 52. As 100% sealing and re-sealing of the uphole sleeve seals 52 at the sealing interface 50 is desired when the sleeves 16 are shifted, any damage at the two uphole sleeve seals 52 or sealing interface 50 in the housing 12 compromises the fracturing or treatment operation.

In normal operation, a leak path P to the reservoir R is created, such as when shear screws 60 engaging the sleeve 16 to the housing 12 during installation and running into the completion string 11 are sheared to allow the sleeve 16 to shift for the first time. Additional leak paths may be present between unsealed areas of an annulus 17 between sleeve 16 and components of the housing 12. In both cases, fluid F under pressure will flow, such as from a tool run into the bore 18, through the leak paths P and to the reservoir R.

If the uphole seal 52, typically an "O" ring seal, is damaged, there is a short period of time between when the sleeve 16 starts to shift to the open position and when the sleeve 16 engages the downhole internal delimiting shoulder 24 in the open position wherein fluid can enter the annulus 17. If this occurs, debris can get into the annulus 17 between the sleeve 16 and the housing 12.

If the downhole "O" ring seal 58 on the sleeve 16 in the prior art sleeve assemblies 10 is damaged when opening the sleeve 16 for the first time, there is a direct leak path P to a set screw, such as is used for filling the annulus 17 with damping grease, to threads securing an uphole section 13 of the housing 12 to a barrel section 15 thereof and to the potentially damaged uphole sleeve seal 52.

If the uphole and downhole seals 52, 58 on the exterior of the sleeve 16 fail, pressure will be allowed into the annulus 17 during the frac treatment. More importantly, if both of the uphole and downhole "O" ring seals 52, 58 are damaged, the sleeve 16 in the prior art sleeve assemblies 10 will not reseal when closed and pressure/fluid will leak to the reservoir R.

Debris D built up at or about the uphole and downhole delimiting shoulders 22,24 may prevent the sleeve 16 from shifting to the fully open and/or closed position. When the sleeve 16 is unable to shift to the fully open or closed positions, uphole and downhole locking arrangements 56, such as detents or the like, located in the annulus 17 and acting between the sleeve and the housing to hold the sleeve 16 in the open or closed position, may not fully engage. As a result, the prior art sleeve 16 cannot reliably remain in the intended open or closed position.

In the prior art sleeve assemblies 10, erosion is highly likely. After fracturing thousands of stages in wellbores, Applicant has observed severe erosion on frac tools when removed from the wellbore after a fracturing operation. It is highly suspected that similar erosion of the prior art sleeves assemblies 10 in the completion string 11 has occurred as well, particularly as the prior art sleeve assemblies 10 appear not to re-seal reliably, as evidenced by pressure testing. Thus, the prior art sleeve assemblies 10 may be unable to maintain successful continuous operation in the field.

As will be appreciated, turbulent flow or channel laminar flow of fluids F about the ports 20 and at least the uphole end 30 of the sleeve 16 during a fracturing operation may result in a wash out area on the internal diameter of the housing 12 or the sealing interface 50, adjacent or about the ports 20. Wash out typically prevents the uphole sleeve seal 52, from sealing at the sealing interface 50 after the fracturing operation is complete.

With the sleeve 16 shifted to the open position as shown in FIG. 2, wash out of the frac ports 20 during the fracturing operation may increase the size of the frac ports 20, may result in cutting of the uphole end 30 of the sleeve 16 and damage to the one or more sleeve seals 52 positioned in close proximity thereto, largely as a result of the abrasive nature of the fluids F in a frac operation.

A downhole sleeve seal 58, such as an "O" ring seal, on the exterior surface 54 of the sleeve 16 or in the housing 12 adjacent the downhole end 32 of the sleeve 16 may also be exposed to debris D, particularly when the sleeve 16 is shifted to the open position for the first time. As is understood generally, seals can be damaged if forced over debris under pressure. Damage to the downhole sleeve seal 58 as a result causes the downhole seal 58 to leak, especially when the sleeve 16 is shifted again to the closed position.

When the downhole seal 58 is damaged by debris, as discussed above, pressure can travel into the annulus 17 between the sleeve 16 and the housing 12 and through the leak paths P to reservoirs R having lower pressure than the wellbore, similar to a thief zone or the like.

As shown in FIG. 3, in the prior art sleeve, the uphole and downhole delimiting shoulders 22,24 expose packer elements 62 in the treatment tool 40, such as a frac tool, run into the sleeve bore 18, to damage if the packer elements 62 engage the internal delimiting shoulders 22,24. Damage occurs particularly when the packer elements 62 are extended outwardly enough to cause swabbing, such as when pulling-out-of-hole (POOH) after a fracturing operation when the frac tool is not pressure balanced. Similarly, damage may occur if the frac tool 40 was set in casing to pressure test, for example below the sleeve assembly 10, and is swabbing to the sleeve 16 during POOH.

Further, other tools such as cement wiper plugs and the like, that extend outwardly enough to engage or catch within the prior art sleeve assemblies 10 are at risk of damage when run-in-hole (RIH) or pulled-out-of-hole (POOH). In the case of cement wiper plugs, it is thought that fins on the wiper plug become less effective in cleaning the cement from the wellbore as the wiper plug passes thru and engages the uphole and downhole delimiting shoulders 22,24 of a plurality of the prior art sleeve assemblies 10, located at the plurality of stages within the wellbore.

Embodiments of Sleeve Assemblies Disclosed Herein

As noted above, sleeves which are shiftable using a locating shifting tool, as taught in Applicant's US published application US2017-0058644-A1, are known. While not limited thereto, embodiments are described herein in the context of a sleeve assembly 100 wherein the sleeve 16 is located and shifted using a locating shifting tool incorporated in a treatment tool 40.

Having reference to FIGS. 4 to 8, and in contrast to prior art FIGS. 1 to 3, sleeve assemblies 100 according to embodiments taught herein, delimit the internal travel of the sleeve 16 using shoulders or stops isolated from the bore 18 of the sleeve 16 and from debris D therein. Instead of the uphole and downhole internal delimiting shoulders 22, 24 of the prior art sleeve assemblies 10, uphole and downhole annular delimiting stops 102, 104 are formed on the exterior surface 54 of the sleeve 16 and extend radially outwardly into the annulus 17 therefrom. Thus, in embodiments of the sleeve assemblies 100, the annular uphole and downhole delimiting stops 102,104 on the sleeve 16, located in the annulus 17, are protected from debris.

In embodiments, the annular uphole and downhole delimiting stops 102, 104 are formed at uphole 101 and downhole 103 ends of a radially outwardly extending profile 105, formed intermediate the exterior sleeve surface 54.

Figure 7A:
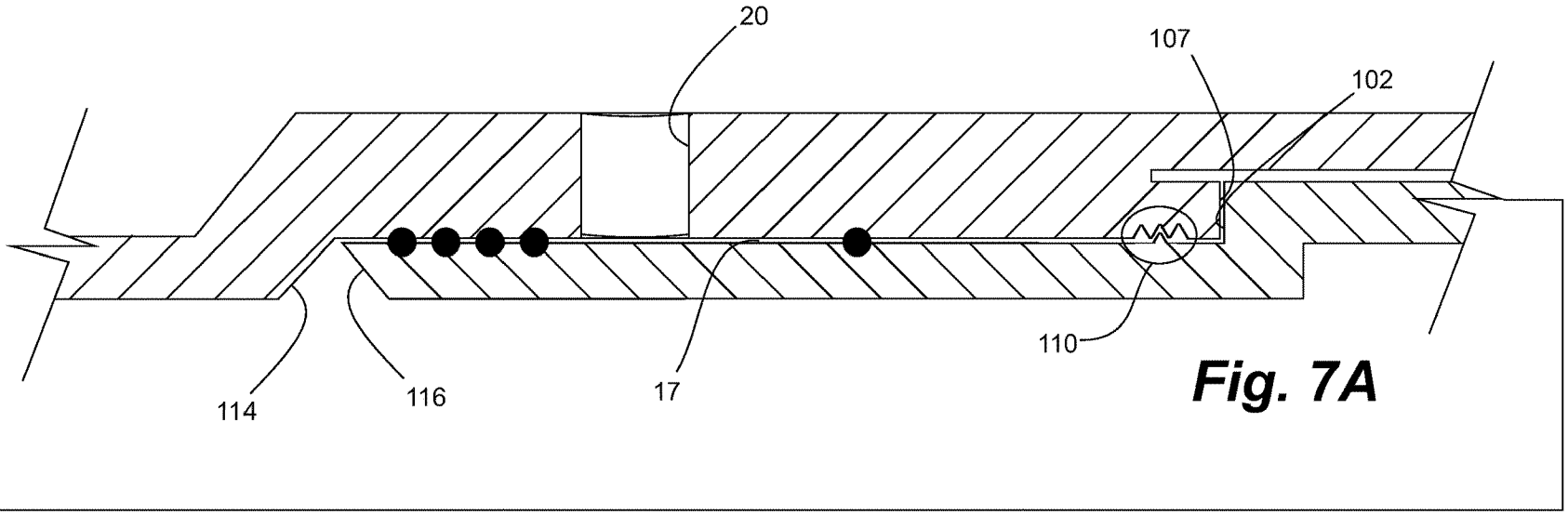
FIG. 7A is a cross-sectional view of an uphole end of an embodiment according to FIG. 4 shown in the closed position, wherein an uphole shoulder in a shifting profile on the housing is formed by an uphole locking mechanism.
Figure 7B:
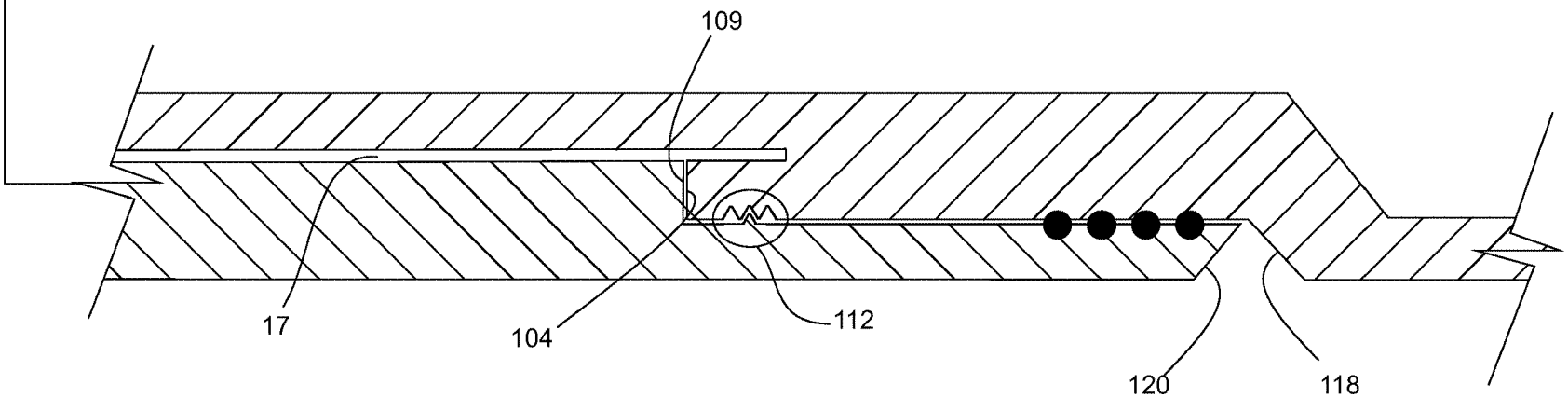
FIG. 7B is a cross-sectional view of a downhole end of an embodiment according to FIG. 2 shown in the open position, wherein a downhole shoulder in a shifting profile on the housing is formed by a downhole locking mechanism.

The annular uphole and downhole delimiting stops 102, 104 engage within an annular shifting profile 106 formed on an interior surface 108 of the housing 12. The annular shifting profile 106 has uphole 107 and downhole 109 annular shoulders formed in the housing 12 at uphole and downhole ends of the annular shifting profile 106. As shown in FIGS. 7A and 7B, in embodiments, the uphole and downhole annular shoulders 107,109 may be formed by uphole and downhole annular locking mechanisms 110, 112, such as detents acting between the housing 12 and the sleeve 16 in the annulus 17 for locking the sleeve 16 to the housing 12 in the closed or open positions.

As the annular shifting profile 106 is located in the annulus 17, the locating shifting tool 36 on the treatment tool 40, travelling within the sleeve bore 18, cannot engage within the shifting profile 106. Thus, the shift length L1, defined by the uphole and downhole annular shoulders 107,109, is no longer limited in length and can be at least equal to or greater than the locating length L2.

Figure 6:
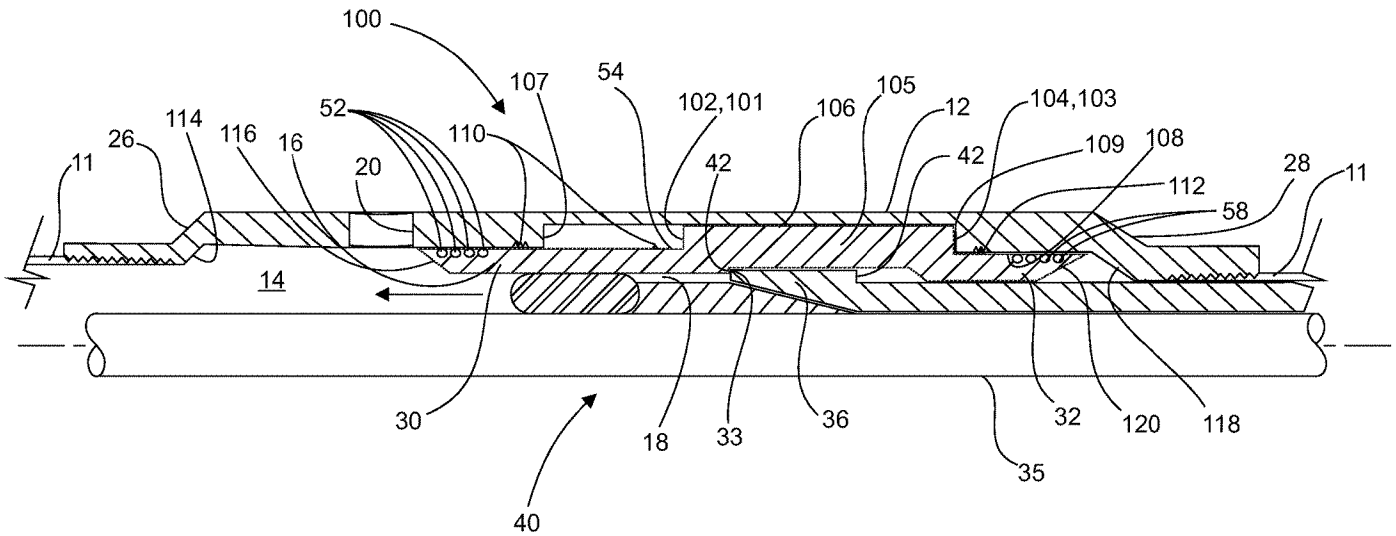
FIG. 6 is a cross-sectional view of the sleeve assembly according to FIG. 4 engaged for shifting uphole.

Further, as shown in FIG. 6, use of annular delimiting stops 102,104 and shoulders 107,109 eliminates areas of potential damage to packer elements 62, cement wiper plugs and the like, and minimizes any catching of tools and tool strings, run through the bore 18 of embodiments of the sleeves assemblies 100 taught herein.

Further still, in embodiments taught herein, because there is no longer a limit to the shift length L1 within the sleeve assembly 100, the sealing length L3 of the sealing interface 50 being increased to at least that of the shift length L1 to improve the reliability of sealing of a plurality of the uphole sleeve seals 52 thereat. Increasing the length of the sealing interface 50 allows for a greater number of uphole sleeve seals 52, such as "O" ring seals. Should one or more of the plurality of uphole sleeve seals 52 or the sealing interface 50 closest to the ports 20 be damaged due to fluid flow thereat, the redundancy created by the plurality of the uphole sleeve seals 52 acts to maintain the ability to reliably seal or re-seal after shifting the sleeve 16 to the open or closed positions for fracturing, without compromising the frac operation.

Further, additional downhole sleeve seals 58 on the exterior surface 40 of the sleeve 16 or in the housing 12 adjacent the downhole end 32 of the sleeve 16 are added to provide redundancy in case one or more downhole sleeve seals 58, adjacent the downhole end of the sleeve 16, are damaged as a result of debris D, particularly when the sleeve 16 is shifted the first time.

In embodiments taught herein, the uphole end 26 of the housing 12 and the uphole end 30 of the internal sleeve 16 are bevelled to form opposing ramps: an uphole housing ramp 114 and an uphole sleeve ramp 116. Similarly, the downhole end 28 of the housing 12 and the downhole end 32 of the internal sleeve 16 are bevelled to form opposing ramps: a downhole housing ramp 118 and a downhole sleeve ramp 120. The uphole and downhole ends 26, 28 of the housing 12 are bevelled outwardly, increasing a diameter of the housing bore 14 as the housing 12 approaches the uphole and downhole ends 30,32 of the sleeve 16 and forming the uphole and downhole housing ramps 114, 118. The uphole and downhole ends 30,32 of the sleeve 16 are bevelled outwardly, increasing a diameter of the sleeve bore 18 at uphole and downhole ends 30,32 of the uphole and downhole sleeve ramps 116,120.

The opposing uphole and downhole ramps 114,116,118, 120 are not intended to act to delimit shifting of the sleeve 16 as the ramps 114,116,118,120 would "mash" together. Instead the ramps 114,116,118,120 are used to aid in minimizing or eliminating the risk of the dogs 36 engaging within any portion of the sleeve 16 except the intended locating profile 34 therein, as the sleeve 16 is shifted axially therein between the open and closed positions. The locating shifting tool 36, expanded into the housing bore 14 above the sleeve 16, when the sleeve 16 is in the open position, or below the sleeve 16 when the sleeve 16 is in the closed position, is guided into and out of the sleeve bore 18 by the bevelled uphole and downhole ramps 114,116,118,120 and thus, do not engage, other than in the locating profile 34 and cannot falsely locate the position of the sleeve 16.

With respect to debris handling, in embodiments taught herein the uphole and downhole ramps 114,116,118,120 act, primarily on a low side of a directional wellbore, to displace debris D into the sleeve and/or housing bore 18,14 away from ends of the sleeve 16 when the uphole or downhole sleeve ramps 116,120 converge on the uphole or downhole housing ramps 114,118, as the sleeve 16 is shifted between the open closed and open positions. Thus, in embodiments of the sleeve assemblies 100 taught herein debris D does not pack about the ramps and the sleeve 16 is more reliably shifted fully to the open and closed positions The uphole and downhole ramps 114,116,118,120 also contribute by removing debris from in front of the plurality of uphole sleeve seals 52 and the one or more downhole seals 58, making the seals 52, 58 less susceptible to damage when the sleeve 16 travels axially back and forth during opening and closing of the ports 20.

As best seen in FIG. 6, in embodiments of the sleeve assemblies 100 taught herein, the housing 12 located adjacent the frac ports 20, is exposed to the frac treatment. When the frac tool 40 is run into the bore 18 of the sleeve 16, an annulus 122 created about the tool 40 is very tight. During the frac treatment, as a result of the fluid flow and the erosive nature of the fluid F, erosion is a serious problem for both the frac tool 40 and the sleeve 16, especially adjacent the frac ports 20. As frac rates become faster, and sand tonnages and sand density become larger in the industry, risk of erosion is even greater.

Figure 5:
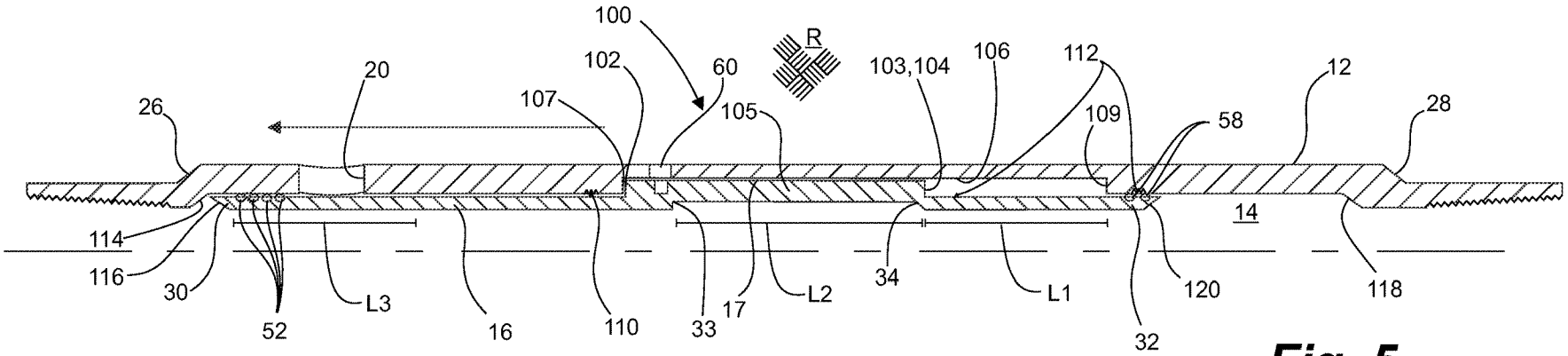
FIG. 5 is a cross-sectional view of a sleeve assembly according to FIG. 4, the sleeve shown in the open position.

Embodiments of the sleeve assemblies 100 as taught herein and shown in FIGS. 5 and 6 are less susceptible to seal damage and leaking through leak paths than the prior art sleeve assemblies 10. The opposing uphole and downhole ramps 114,116,118,120 remove debris D from in front of the sleeve 16 as the sleeve 16 travels axially within the housing 12 between the open and the closed positions. Further, the plurality of seals 52, 58 ensures that even if one or more of the plurality of uphole seals 52, one or more downhole seals 58 or the uphole end 30 of the sleeve 16 sustains some damage, there is a redundancy of seals 52, 58 and sufficient sealing interface 50 about the ports 20 remaining intact to maintain sealing integrity.

In embodiments, hard wiper material may be installed on a leading edge of the "O" ring seals 52, 58 to keep debris D away from the "O" ring seals 52, 58. Thus, debris damage to the seals 52, 58 is at least minimized. In embodiments, wiper seals (not shown) are installed on all leading edges of the seals 52, 58 that may be exposed to debris D during movement of the sleeve 16 to both the open and closed positions.

In contrast to the prior art sleeve assemblies, in embodiments of the sleeve assemblies 100 taught herein, the longer sealing interface 50 area as well as the increased number of uphole sleeve seals 52 to seal thereagainst results in improved sealing and re-sealing when the sleeves 16 are closed after fracturing despite some erosion, as is evidenced by straight line pressure test results. Using embodiments taught herein, downtime as a result of failures to properly seal are minimized and may be eliminated.

Further, as a result of the unlimited travel distance of the sleeve 16, in embodiments the uphole end 30 of the sleeve 16 can be spaced further away from the frac ports 20. Increasing the distance the uphole end 30 is spaced from the ports 20 increases the likelihood that the uphole end 30 of the sleeve 16 will not wash out and that the uphole sleeve seals 52 are protected. Increasing an axial travel distance of the sleeve 16 away from the frac ports 20 in the open position also increases the probability that the uphole sleeve seals 52 are not washed out by the frac treatment.

In the case of embodiments of the sleeve assemblies 100 taught herein, removing the prior art limitation on the shift length L1, which permits the extended sealing interface 50 and the greater number of uphole sleeve seals 52, positioning of the annular delimiting stops 102, 104 and shoulders 107,109 in the annulus 17 between the housing 12 and the sleeve 16, and displacement and removal of debris D as a result of the opposing uphole and downhole ramps 114,116, 118,120, greatly improve sleeve performance.

Figure 8:
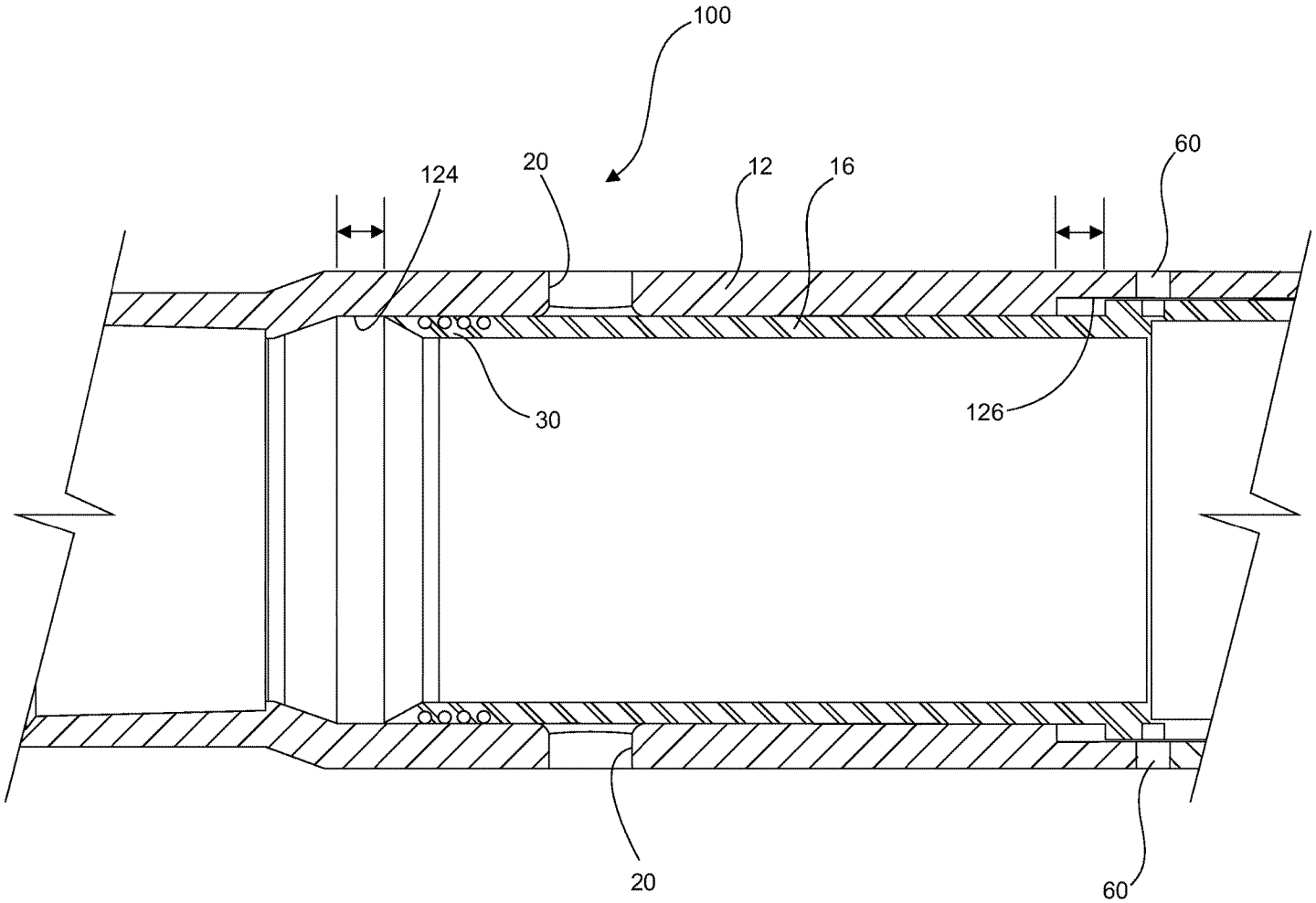
FIG. 8 is a partial cross-sectional view of another embodiment of a sleeve assembly as taught herein having an axial recess to permit release of the sleeve prior to shifting thereof.

Having reference to FIG. 8, in embodiments the sleeve 16 can be released from an initial locked position, wherein the sleeve 16 is locked to the housing 12, such as by shear screws 60, using an uphole pull rather than force applied downhole.

Figure 4:
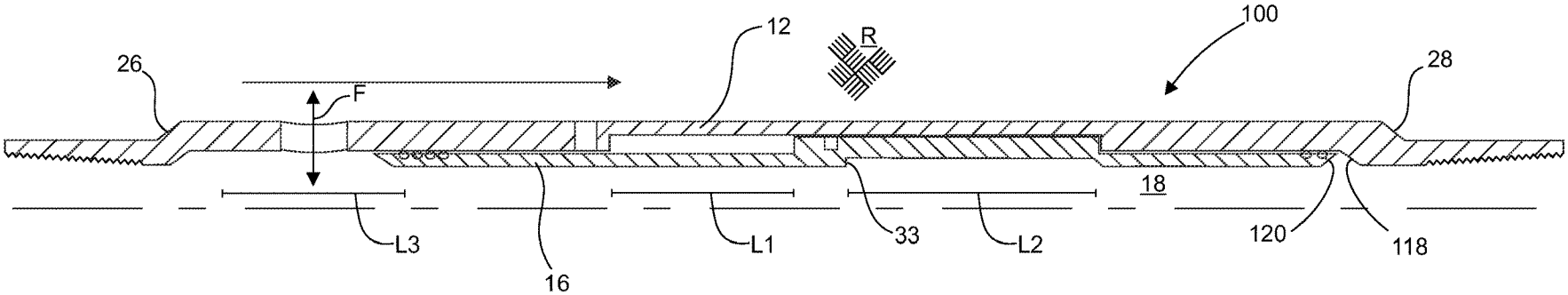
FIG. 4 is a cross-sectional view of one side of a sleeve assembly according to an embodiment taught herein, the sleeve shown in the closed position an opposing identical wall having been removed for simplicity.

Having reference to FIG. 8, unlike the previous embodiments of the sleeve assemblies 100, such as shown in FIG. 4, an axial recess 124 is located uphole from the ports 20 and axially uphole of the uphole end 30 of the sleeve 16 in the closed position. The shift profile 106 in the housing 12 is also lengthened compared to the previous embodiments by about the same length as the axial recess 124. The sleeve 16 is also initially releasably engaged to the housing 12, spaced downhole from the uphole shoulder 107 the length of the axial recess 124, using the shear screw 60, in an initial closed position. Accordingly, during an uphole pull to locate and release the sleeve 16 from the housing 12, the locating shifting tool 36 first engages within the locating profile 34. A further, predetermined additional pull-up weight is applied to shear the screw 60 and release the sleeve 16 from the housing 12. The sleeve 16 initially moves axially uphole into the axial recess 124, shearing the shear screws 60 and releasing the sleeve 16. Thereafter, an operator can apply a downhole force, such as a mere mechanical set down weight with the conveyance tubing, to shift the sleeve 16, thereby obviating the prior art need for combining setdown weight and an additional fluid pumping to apply hydraulic force thereto.

In yet another embodiment, a jar tool is provided, such as above the treatment tool 40. The locating shifting tool 36 on the treatment tool 40 are first engaged with the locating profile 34 and conveyance tubing/coiled tubing weight is used to actuate the jar tool to release the sleeve 16, either uphole or downhole and enable sleeve shifting. Mechanical movement of the conveyance tubing actuates the sleeve 16.

In yet another embodiment, each sleeve 16 is fit to the sleeve housing 12 with a primary hydraulic chamber filled with an incompressible fluid, such as an oil, hydraulic fluid or grease. An orifice is provided to provide an outlet for the fluid from the primary chamber. The locating shifting tool 36 is set to the sleeve's locating profile 34 and a persistent force, uphole or downhole, is applied to the sleeve 16 to displace the fluid from the primary chamber over time to enable free axial shifting movement thereafter. In an embodiment, the hydraulic fluid moves from the primary chamber and into the sleeve bore 18 or the wellbore annulus. In another embodiment, the fluid can move between the primary chamber to a secondary and larger chamber, formed in the annulus 17 between the sleeve housing 12 and sleeve 16, moving fluid from one end of the sleeve 16 to the other.

Embodiments of sleeve assemblies 100 taught herein are generally actuated in accordance with Applicant's co-pending US published application US2017-0058644-A1, incorporated herein by reference in its entirety. The sleeves 16 may be activated in any sequence in the wellbore, from heel to toe, or toe to heel or alternatively, can be individually actuated in any sequence as desired.

Having reference to FIGS. 9A-9D, once the treatment tool 40 is lowered to a desired depth below a sleeve assembly 100 of interest, the tool 40 is cycled from a Run-In-Hole position to a Pull-to-Locate position, using an axially indexing J-slot mechanism. The uphole movement the treatment tool 40 moves the inner activation mandrel 35 of the tool 40 to transition the J-slot mechanism to an "up position" U (FIG. 9B), while an outer housing of the J-slot mechanism is held rotationally static in position by drag blocks on the tool 40. The drag blocks provide sufficient axial restraining force for the biased energizing of the locating shifting tool or dogs 36 outward towards the casing. Dog arms 38 and dogs 36 are held against the casing 11 with a spring force and this force can be adjusted on a per dog basis or group basis as the case may be. Biasing springs 39 are cantilevered leaf or collet-like springs, the ends of each leaf radially biasing the dog arms 38 outwardly. The force on the dogs 36 is also balanced even if the tool 40 is not centralized in the well. Only one dog 36 is required to engage the locating profile 34 to ensure surface-detected location of the tool 40 in the sleeve 16. The dogs 36 are designed in such a way that one dog 36 alone can withstand the entire load capacity of a coiled tubing injector at surface. This design is a positive location; once engaged, the dogs 36 remain engaged until the J-Slot is cycled or an emergency release is actuated.

Positive location is a significant departure from conventional sleeve tools. The movement of a tool is often many kilometers downhole, and the coiled tubing string mechanics associated therewith are significant.

Positive sleeve location is an important factor in objectives to minimize sleeve length and cost. Without positive dog-to-sleeve indication, optimizing the shortest sleeve possible is difficult if not impossible, as there simply is not enough room for axial placement errors, including setting high or too low. On uphole movement during locating from sleeve 16 to sleeve 16, the dogs 36 are guided through the housing and sleeve bores 14, 18 by the ramps 114, 116, 118, 120 on the housing 12 and sleeve 16 and therefore do not engage any annular recess other than the sleeve's locating profile 34, and once engaged, there is no accidental movement to permit one to pull past the uphole stop 33 and out of the locating profile 34, the dogs 36 being locked in the locating profile 34, unless emergency release tactics are required.

With the dogs 36 engaged in the locating profile 34, only extraordinary efforts will permit the tool 40 to move, transitioning from locating to shifting the sleeve 16. If there was a tool failure, the dogs 36 may be released from the locating profile 34 by cycling the tool 40 or pulling extreme loads on the tool 40 to force the dogs 36 into collapse.

As the dogs 36 move uphole from the casing 11 to the sleeve 16, the dogs 36 are designed not to locate in any gap at the bottom of the sleeve 16 when the sleeve 16 is closed. The dogs 36 engage the locating profile 34 as discussed above preventing the tool 40 from traveling further uphole and providing positive indication at surface, for example about 5,000 to about 10,000 daN, that the sleeve 16 has been located.

To lock the dogs 36 into the locating profile 34, the J-slot is cycled to a "run-in-hole (RIH) position". During this transition, the tool 40 is held in position by drag blocks while the inner activation mandrel 35 travels downhole, also moving an annular restraining ring about the dogs 36 to its downhole-most position adjacent a pivot, maximizing the dog arm movement. Similarly the cone 37 moves with the activation mandrel 35 downhole to approach the dogs 36. The radially outward biasing of the dogs 36 with the compressed spring 39 is locked with the ramped face of the cone 37 and dog 36 engagement. The cone 37 mechanically forces the dogs 36 outwards.

Figure 9A:
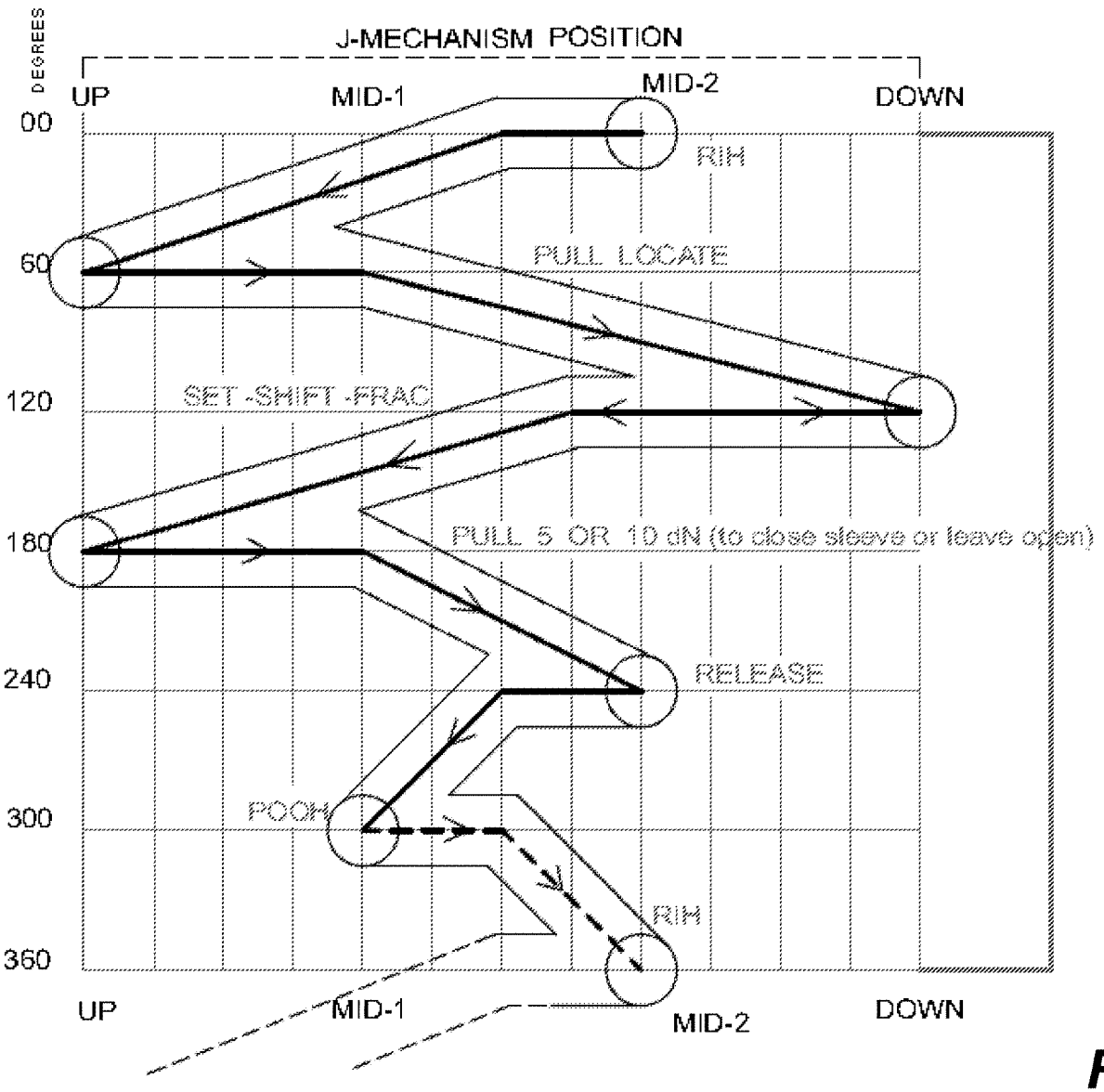
FIG. 9A is a rolled-out view of one embodiment of a J-profile suitable for a downhole direction shifting of embodiments of the sleeve of FIGS. 4 to 6.
Figure 9B:
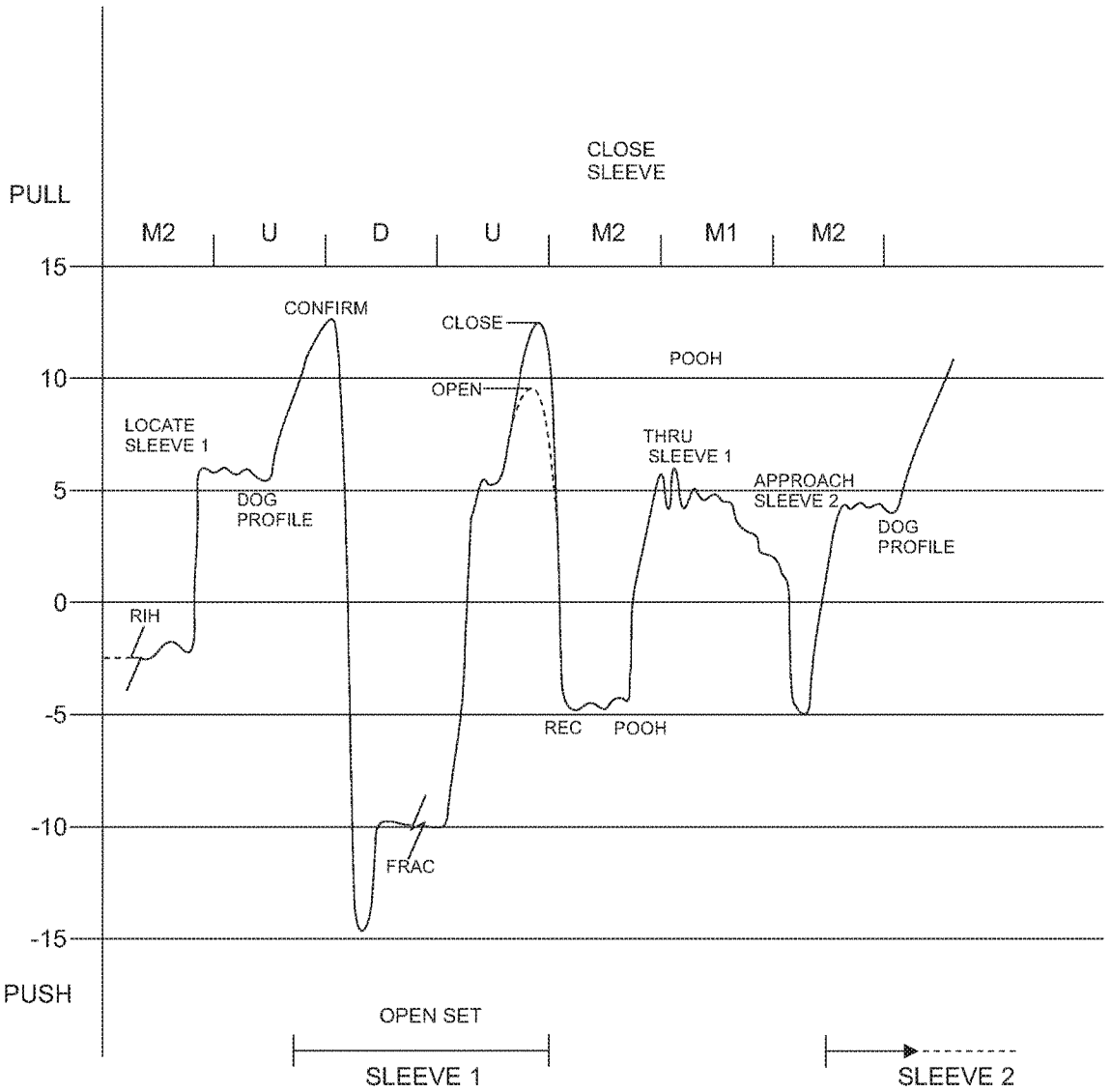
FIG. 9B is a conveyance string weight and sequence for the J-Slot for a first sleeve, treatment and then subsequent sleeve operation.
Figure 9C:
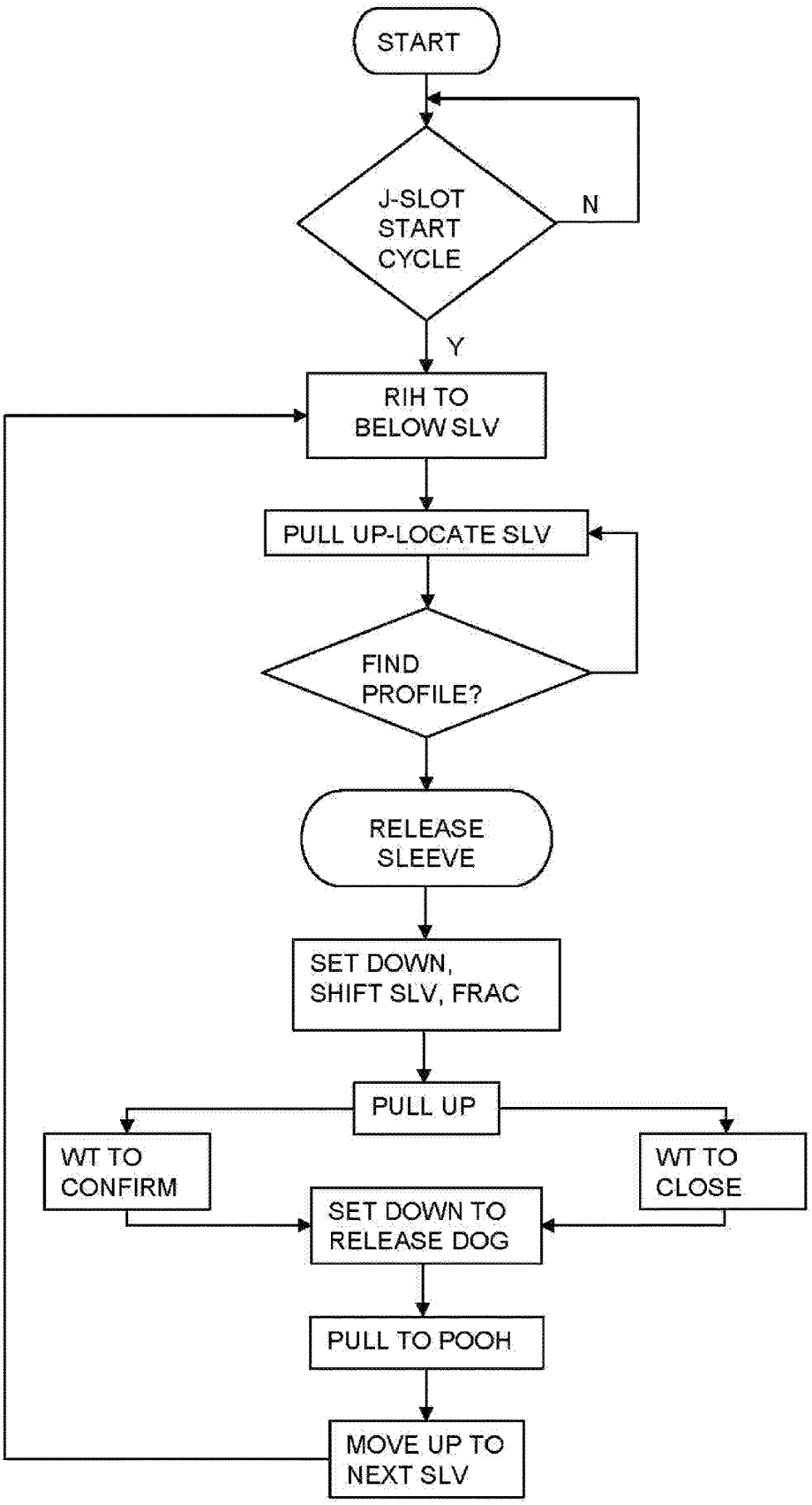
FIG. 9C is a flow chart of the sequence of operation for treatment and optional post-treatment sleeve closing before moving to next sleeve.
Figure 9C:
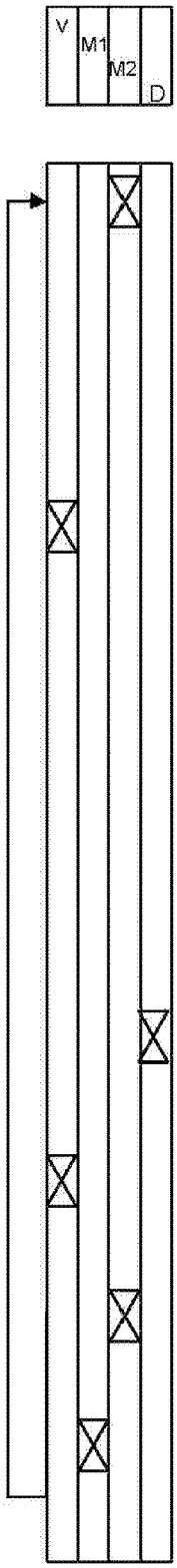
Figure 9D:
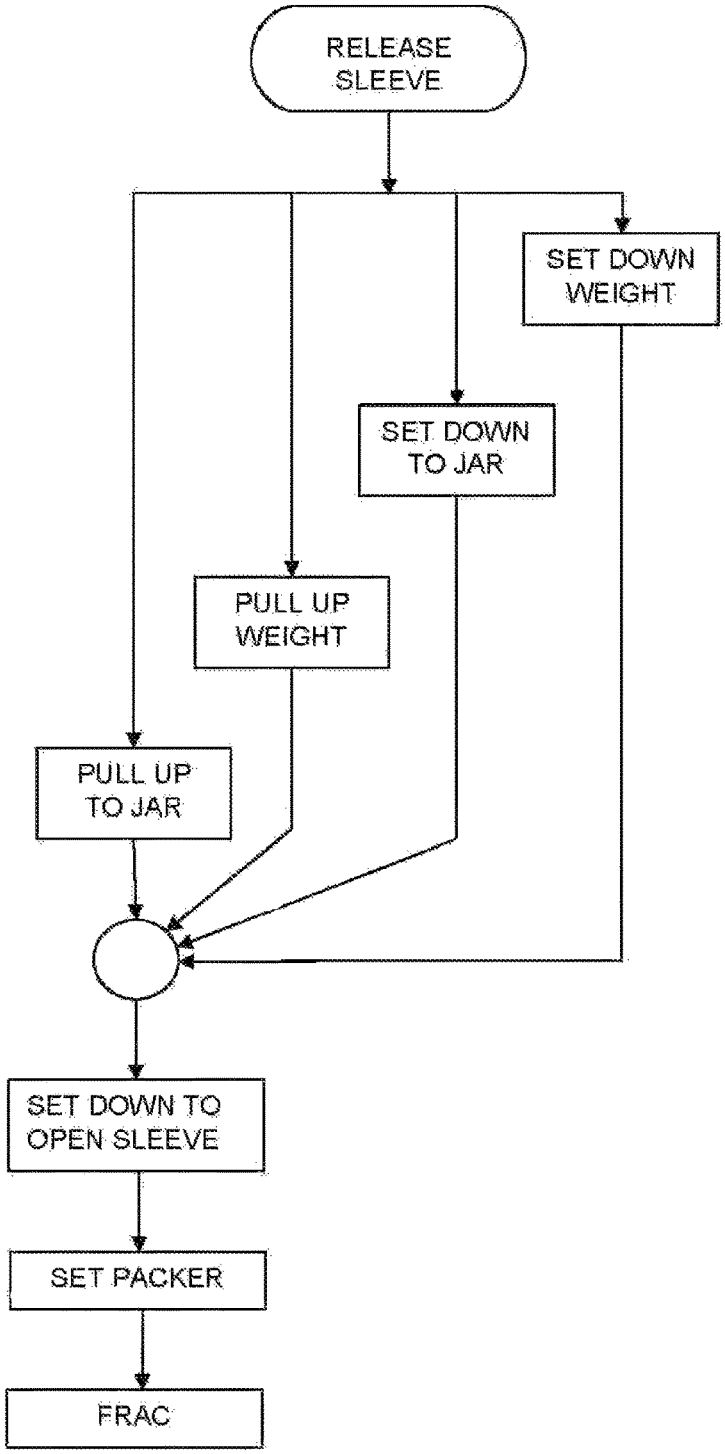
FIG. 9D is a sub-flow chart of the sequence of operation for optional modes for releasing the sleeve prior to sleeve opening.
Figure 9D:
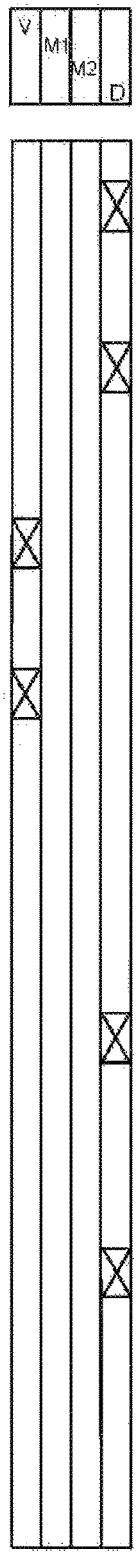

If it's required, the sleeve 16 can be shifted down with coiled tubing force from surface and/or fluid pressure above the tool 40. With reference to FIG. 9D, as discussed above, there are other options to release the sleeve 16 so as to enable shifting open, including an initial overpull uphole, or using a jar, or using persistent tubing weight to overcome a hydraulic reservoir.

Herein, having reference again to FIG. 8, in embodiments the initial shift of the sleeve 16 can be controlled by overcoming shear screws 60 with predetermined shear strength. Once the shear value of the shear screws is overcome the sleeve 16 is allowed to travel down. The number of screws 60 may be adjusted to desired operating parameters.

Further, a sleeve shift dampening system can be provided as taught in Applicant's U.S. Pat. No. 9,840,888, incorporated herein by reference, to control the acceleration of the sleeve 16 and the shock load when the sleeve 16 reaches the downhole position. By minimizing the shock load, tool longevity is greatly increased and a fluid hammer shock load to the open formation is contained so as not to exceed frac breakdown pressures of the formation.

Opening of the sleeve 16 is indicated at surface by a reduction in coiled tubing string weight. This is important in the event of troubleshooting problems related to breaking down the formation for example, because it eliminates the concern of sleeve malfunction. Again, having the annular uphole and downhole delimiting stops 102.104 and the specific locating profile 34 in the sleeve 16 also eliminates high or low setting of the tool 40, which further minimizes troubleshooting formation breakdown.

Pull or push loads to close and re-open the sleeve 16, after the initial opening of the sleeve 16, are generally controlled by the annular uphole and downhole locking arrangements or detents 56. For example, a detent release load is typically set to 5,000 to 10,000 daN.

After treatment, one can choose to close the sleeve 16 and move the tool 40 to the next zone of interest. In the downhole-shift-to-open embodiment, closing the sleeve 16 can be achieved with an overpull sufficient to overcome the downhole detent 112. Depending on the detent design threshold, the detent 56 can be overcome by over-pulling the coiled tubing string weight beyond a threshold, such as over about 5,000 daN. A typical range is between about 5000 daN to about 10,000 daN, or even above about 10,000 daN to upwards of about 15,000 daN. In embodiments, maximum upper thresholds are in the order of about 13,000 to about 15,000 daN.

When the sleeve 16 is first opened, the downhole detent 112, such as an annular lip about the sleeve 16 at the downhole end of the sleeve 16, is engaged in a corresponding annular detent, ratchet or receiver on the housing 12 to retain the sleeve 16 in the open position until purposefully actuated to the closed position. The tool 40 can be cycled uphole by overcoming the downhole detent 112 and thereafter cycled downhole again at some later time. Cycling uphole either enables J-Slot transition to the next stage, or confirms the sleeve 16 was engaged. Cycling downhole thereafter transitions to the next stage.

One can cycle the tool 40 uphole, at a weight indicated at less than a threshold if it is desired to leave the sleeve 16 open, and thereafter be cycled downhole. Alternately, one can cycle the tool 40 uphole, at a weight indicated greater than a threshold to overcome the downhole detent 112 to close the sleeve 16, and only then cycle the tool 40 down.

Thus, upon completion of the frac, the sleeve 16 may be closed or left open. Thereafter, the coiled tubing is cycled downhole to release the cone 37 from the dogs 36, and the J-Slot mechanism is cycled to the "M2 position" (FIG. 9B) in preparation for moving uphole or POOH.

During uphole movement for closing the sleeve 16, the inner activation mandrel 35 starts to move uphole, opening a bypass valve and tension release of an annular packer seal. The pressure across the tool 40 is equalized and debris D is flushed from the tool 40. The cone 37 disengages from under the dogs 36 and the inner activation mandrel 35 transitions from locked dogs 36 to spring biased or supported dogs 36. During this transition, the dogs 36 cannot move in the sleeve 16 as the dogs 36 are still engaged with the locating profile 34. The dogs 36 travel axially within the locating profile 34.

When the dogs 36 engage an uphole end of the locating profile 34, a net weight indication is indicated at surface. The weight indication can be set to any loading or threshold, in this case from about 5,000 to about 15,000 daN over coiled tubing string weight. This weight range is an example of a range selected to have a loading significant enough to be realized and observable at surface. Surface weight indication for locating the sleeve, shifting it open and shifting it closed is useful with regards to operational confidence and optimizing operations at surface.

The purpose of closing the sleeve 16 right after the frac includes isolation of the frac treatment in the reservoir by not allowing it to flow back into the well. By isolating the frac treatment the formation is allowed to heal, containing the frac sand and reducing sand production in the well, which ultimately would have to be recovered at some expense. A further purpose includes isolation of the frac treatment from other previously frac'd sleeves/stages to prevent cross flow in the well. Further still closing the sleeve 16 minimizes the amount of clean fluid required to clean the tools 40 travelling to the next stage.

The sleeves 16 may be re-opened at any time. For example, if a well is frac'd from the toe to the heel, once the last sleeve 16 is closed at the heel, the coiled tubing can travel back to the toe and the process of locating and opening all the sleeves 16 can proceed stage to stage back to the heel. The sleeves 16 can be opened days or weeks or months later as another option. Generally, these time periods are reservoir and area specific. Further, in embodiments, only select sleeves 16 are opened or closed as desired to control fluid flow.

When the sleeve 16 shifts from the open to the closed position, the sleeve 16 is dampened in reverse and the shock load of the closing action is transferred to surface through indication, by way of a coiled tubing string weight loss.

Further, when the sleeve 16 is closed, the coiled tubing may be over-pulled, for example, at weight greater than about 10,000 daN, which is observable at surface to confirm closure. In most cases however, this is not necessary.

When the sleeve 16 is closed, the well at that zone is isolated. The tool dogs 36 are released from the sleeve 16 by RIH with the coiled tubing, shifting the J-Slot to the M2 position. The inner activation mandrel 35 travels downhole to a "dog release position" in the J-Slot mechanism. An annular retainer ring forces the dogs' arms 38 to the radially withdrawn position. The outer J-Slot housing is restrained by the drag block and the inner activation mandrel 35 cycles the J-slot mechanism to a "release position". Once the mandrel 35 travel sufficiently downhole, arm cam's are forced by the retainer ring to collapse the dogs 36 from the locating profile 34, the dogs 36 are unlocked from the sleeve 16 and the tool 40 is free to travel downhole.

Leaving the sleeve 16 open may be accomplished in a couple of ways. A first method is not to exceed the net weight required to overcome the downhole detent 56, such as string weight load plus about 5000 daN, when confirming the engagement of the tool 40 with the locating profile 34 sleeve. If the detent 56 releasing load in the sleeve 16 is not exceeded, the sleeve 16 will not shift. Verification that the sleeve 16 has not shifted is seen as a lack of a weight loss at surface when pulling up on the coiled tubing. As in closing the sleeve 16, the tool 40 is thereafter cycled as described above for unlocking the dogs 36.

After pulling the coiled tubing uphole to a load less than the about 5,000 daN over coiled tubing string load, the operator causes the tool 40 to travel downhole with the coiled tubing. The tool 40 again transitions from dogs 36 being forced outwardly to forcing the dogs inwardly via the retainer ring acting on the arm cams surface. Once the retainer ring forces the dogs 36 to the collapsed position, the tool 40 can travel downhole.

Another method of leaving the sleeve 16 open after the frac or stimulation treatment is to provide an alternate J-Slot pattern so that the sequence to optionally close the sleeve 16 is eliminated. Rather than an uphole path to the "extreme uphole position" (U), the J-slot could terminate at an "intermediate M1 position" for POOH. This would allow the tool 40 to be pulled out of the sleeve 16 without having to travel down to release the tool 40. The J-Slot mechanism may have various configurations and sequence patterns to provide a means to change several of the operating parameters of the tool.

With the tool 40 released from sleeve 16, whether leaving the sleeve 16 open or closed, the tool 40 is run-in-hole (RIH), the tool 40 travelling downhole with all of the dogs 36 retracted. Running the tool 40 strictly shifted to the RIH mode, configures the tool 40 as a slick line tool where no engagement with the sleeves 16 or casing collars is indicated, unless the stacked beam drag block assembly is set up with a backup location dog for the sleeve 16.

After RIH to free the tool 40 from the sleeve 16, the coiled tubing direction is reversed to move uphole for relocation or POOH.

Embodiments in which an exclusive property or privilege is claimed are defined as follows:

1. A sleeve assembly comprising:

a tubular sleeve housing having a housing bore formed therethrough, the housing having one or more ports formed therethrough; and a shifting profile formed in an inner surface of the housing bore, the shifting profile having an uphole shoulder and a downhole shoulder; and an axially shiftable tubular sleeve, housed within the housing bore of the sleeve housing and forming a sleeve annulus therebetween, the sleeve having a bore formed therethrough;

a locating profile formed in an interior of the sleeve, adapted for engaging a shifting locator therein;

annular uphole and downhole stops formed on an exterior of the sleeve and extending into the sleeve annulus for engaging the uphole and downhole shoulders of the shifting profile for delimiting the axial movement of the sleeve between a closed position, wherein the sleeve blocks the ports, and an open position, wherein the sleeve is shifted axially away from the ports; and opposing ramps formed on uphole ends of the sleeve and the housing and on downhole ends of the sleeve and the housing, the opposing ramps guiding the shifting locator into and out of the housing bore and the sleeve bore when the shifting locator is disengaged from the locating profile.

2. The sleeve assembly of claim 1, wherein a shift length of the sleeve within the shifting profile is equal to or greater than a length of the locating profile.

3. The sleeve assembly of claim 1, wherein:

the uphole and downhole ends of the housing are beveled outwardly for forming the housing bore increasing a diameter of the housing bore adjacent the uphole and downhole ends of the sleeve for forming the uphole and downhole housing ramps; and the uphole and downhole ends of the sleeve are beveled outwardly for increasing a diameter of the sleeve bore at uphole and downhole ends of the uphole and downhole sleeve ramps, the sleeve ramps converging toward the housing ramps.

4. The sleeve assembly of claim 1, wherein when the sleeve is shifted to the open or the closed position, debris is displaced into the sleeve bore, the housing bore or both as the uphole or downhole sleeve ramps converge on the uphole or downhole housing ramps respectively.

5. The sleeve assembly of claim 1 further comprising uphole and downhole locking mechanisms in the sleeve annulus for acting between the housing and the sleeve to lock the sleeve in the closed or open positions when shifted thereto.

6. The sleeve assembly of claim 5, wherein the shifting profile's uphole shoulder is formed by the uphole locking mechanism, and wherein the shifting profile's downhole shoulder is formed by the downhole locking mechanism.

7. The sleeve assembly of claim 5, wherein the locking mechanisms are detents.

8. The sleeve assembly of claim 2, wherein the housing comprises a sealing interface about the ports, the sealing interface having a length at least equal to the shift length.

9. The sleeve assembly of claim 1 further comprising one or more shear screws for retaining the sleeve to the housing in an initial closed position.

10. The sleeve assembly of claim 2, wherein the housing further comprises an axial recess uphole from the ports and uphole from the uphole end of the sleeve, the sleeve being spaced from the uphole shoulder the length of the axial recess and retained to the housing in an initial closed position, an initial uphole axial movement of the sleeve therein releasing the sleeve to permit shifting downhole a first time.

11. A method for locating a shifting tool in a sleeve, the sleeve being axially moveable within a housing for shifting the sleeve axially therein between uphole and downhole positions, comprising:

running the shifting tool downhole, through a bore of the sleeve, to below a downhole end of the sleeve;

pulling the shifting tool uphole, the shifting tool being guided uphole past a downhole housing ramp and into the downhole end of the sleeve by a downhole sleeve ramp formed thereon;

continuing to pull the shifting tool uphole to engage in the sleeve axially moving the locating shifting tool and, sleeve engaged therewith, between the uphole and downhole positions, wherein uphole and downhole stops in an annulus between the sleeve and the housing engage uphole and downhole shoulders therein, the annular stops and annular shoulders acting between the sleeve and the housing to delimit the axial movement of the sleeve;

pulling the shifting tool uphole out of the bore of the sleeve by disengaging the shifting tool from the sleeve; and pulling the shifting tool uphole to move from an uphole end of the sleeve by an uphole sleeve ramp and into a bore in the housing guided by an uphole housing ramp formed at an uphole end of the housing.

12. The method of claim 11 when the sleeve is shifted to an uphole position and the shifting tool in the sleeve is to be moved downhole out of the sleeve further comprising:

disengaging the shifting tool from the sleeve; and moving the shifting tool from the sleeve and guided by the downhole sleeve ramp and into the bore in the housing therebelow by the downhole housing ramp formed at an downhole end of the housing to below the downhole end of the sleeve; and continuing to move the locating shifting tool downhole through the bore of the housing therebelow.

13. The method of claim 11, wherein the sleeve is retained to the housing in an initial uphole position prior to shifting downhole a first time, comprising:

pulling the shifting tool and sleeve engaged therewith uphole into an axial recess in the housing, the axial recess being uphole of the sleeve in the uphole position, for disengaging the sleeve from the housing; and thereafter axially moving the locating shifting tool downhole for axially shifting the sleeve to the downhole position, the annular stops and annular shoulders acting between the sleeve and the housing to delimit the axial movement of the sleeve.

14. The method of claim 11, further comprising:

displacing debris into the sleeve bore, a housing bore or both when the uphole sleeve ramp converges toward the uphole housing ramp when the sleeve is shifted to the uphole position, the annular stops and annular shoulders acting between the sleeve and the housing to delimit the axial movement of the sleeve; and displacing debris into the sleeve bore, the housing bore or both when the downhole sleeve ramp converges toward the downhole housing ramp when the sleeve is shifted to the downhole position, the annular stops and annular shoulders acting between the sleeve and the housing to delimit the axial movement of the sleeve.

15. The method of claim 11, wherein engaging the shifting tool and sleeve comprises engaging a shifting locator of the shifting tool with a locating profile in the sleeve; and when the sleeve is shifted to a downhole position and the shifting tool is to be pulled uphole out of the sleeve bore further comprising:

disengaging the shifting locator from the locating profile;

pulling the shifting tool uphole for move the shifting tool from the uphole end of the sleeve; and guiding the shifting locator out of the sleeve bore and int the housing bore by the opposing ramps.

16. The method of claim 15, wherein when shifting tool is to be run downhole out of the sleeve bore further comprising:

disengaging the shifting locator from the locating profile;

moving the shifting tool downhole from the downhole end of the sleeve; and guiding the shifting locator out of the sleeve bore and into the housing bore by the opposing ramps.

17. A sleeve assembly comprising:

a tubular sleeve housing having a housing bore formed therethrough, the housing having one or more ports formed therethrough; and a shifting profile formed in an inner surface of the housing bore, the shifting profile having an uphole shoulder and a downhole shoulder; and an axially shiftable tubular sleeve adapted for axial shifting movement by a shifting tool guided therethrough, the sleeve housed within the housing bore and forming a sealed sleeve annulus therebetween, the sleeve having a sleeve bore formed therethrough;

annular uphole and downhole stops formed on an exterior of the sleeve and extending into the sleeve annulus for engaging the uphole and downhole shoulders of the shifting profile for delimiting the axial movement of the sleeve when the shifting tool shifts the sleeve between a closed position, wherein the sleeve blocks the ports, and an open position, wherein the sleeve is shifted axially away from the ports; and opposing housing and sleeve ramps formed on opposing uphole ends of the sleeve and housing bore and on opposing downhole ends of the sleeve and housing bore, the opposing ramps guiding the shifting tool into and out of the housing bore and the sleeve bore.

18. The sleeve assembly of claim 17, wherein the uphole and downhole ends of the housing are beveled outwardly for forming the housing bore, increasing a diameter of the housing bore adjacent the uphole and downhole ends of the sleeve for forming the uphole and downhole housing ramps; and the uphole and downhole ends of the sleeve are beveled outwardly for increasing a diameter of the sleeve bore at uphole and downhole ends of the uphole and downhole sleeve ramps, the sleeve ramps converging toward the housing ramps.

19. The sleeve assembly of claim 17, wherein when the sleeve is shifted to the open or the closed position, debris is displaced into the sleeve bore, the housing bore or both as the uphole or downhole sleeve ramps converge on the uphole or downhole housing ramps respectively.

20. The sleeve assembly of claim 17 further comprising uphole and downhole locking mechanisms in the sleeve annulus for acting between the housing and the sleeve to lock the sleeve in the closed or open positions when shifted thereto.

21. The sleeve assembly of claim 20 wherein, the shifting profile's uphole shoulder is formed by the uphole locking mechanism, and wherein the shifting profile's downhole shoulder is formed by the downhole locking mechanism.

22. The sleeve assembly of claim 20, wherein the locking mechanisms are detents.

23. The sleeve assembly of claim 17, wherein the housing comprises a sealing interface about the ports, the sealing interface having a length at least equal to a shift length of the sleeve.

24. The sleeve assembly of claim 17 further comprising one or more shear screws for retaining the sleeve to the housing in an initial closed position.

25. The sleeve assembly of claim 17, wherein the housing further comprises an axial recess uphole from the ports and uphole from the uphole end of the sleeve, the sleeve being spaced from the uphole shoulder the length of the axial recess and retained to the housing in an initial closed position, an initial uphole axial movement of the sleeve therein releasing the sleeve to permit shifting downhole a first time.

26. The sleeve assembly of claim 17, further comprising a locating profile formed in an interior of the sleeve and having a length between uphole and downhole locator stops, the locating profile adapted for receiving a shifting locator of the shifting tool therein for engaging the shifting tool and the sleeve; and wherein a shift length of the sleeve along the shifting profile is equal to or greater than a length of the locating profile.

27. The sleeve assembly of claim 26, wherein the opposing ramps guide the shifting locator into and out of the housing bore and the sleeve bore when the shifting locator is disengaged from the locating profile.

28. The sleeve assembly of claim 23, wherein the sealing interface has a length greater than the shift length to allow the use of additional sealing members.

* * * * *